US011242712B2

(12) United States Patent
Chuang

(10) Patent No.: US 11,242,712 B2
(45) Date of Patent: Feb. 8, 2022

(54) VERTICAL BLINDS

(71) Applicant: ABO WINDOW FASHION CORP, Chino, CA (US)

(72) Inventor: Shan-Chi Chuang, New Taipei (TW)

(73) Assignee: ABO WINDOW FASHION CORP., Chino, CA (US)

( * ) Notice: Subject to any disclaimer, the term of this patent is extended or adjusted under 35 U.S.C. 154(b) by 306 days.

(21) Appl. No.: 16/273,555

(22) Filed: Feb. 12, 2019

(65) Prior Publication Data

US 2020/0256123 A1 Aug. 13, 2020

(51) Int. Cl.
*E06B 9/326* (2006.01)
*E06B 9/36* (2006.01)

(52) U.S. Cl.
CPC ..... *E06B 9/364* (2013.01); *E06B 9/326* (2013.01)

(58) Field of Classification Search
CPC . E06B 9/36; E06B 9/362; E06B 9/364; E06B 9/367; E06B 9/368; E06B 9/326; A47H 2/00; A47H 2023/025; A47H 15/02; A47H 2001/047; E05D 15/0626; E05D 15/0652; E05D 15/0647
See application file for complete search history.

(56) References Cited

U.S. PATENT DOCUMENTS 3,348,603 A * 10/1967 Ford ..... E06B 3/4609 160/197
3,911,991 A * 10/1975 Malferrari ..... A47H 23/00 160/202
6,892,783 B1 * 5/2005 Comeau ..... A47H 1/08 160/126
7,270,165 B1 * 9/2007 Chuang ..... E05D 15/0647 160/197
7,299,852 B1 * 11/2007 Chuang ..... A47H 15/04 160/197
2006/0249260 A1 * 11/2006 Nien ..... E06B 9/262 160/84.03
2007/0158036 A1 * 7/2007 Lin ..... A47H 23/05 160/197
2007/0261799 A1 * 11/2007 Chu ..... E06B 9/36 160/197
2008/0163986 A1 * 7/2008 Li ..... A47H 23/04 160/175
2011/0272104 A1 * 11/2011 Dimitrakoudis ..... E06B 9/36 160/188

FOREIGN PATENT DOCUMENTS

EP 3485767 A1 * 5/2019 ..... A47H 5/03

* cited by examiner

*Primary Examiner* — Daniel P Cahn
*Assistant Examiner* — Matthew R. Shepherd

(57) ABSTRACT

A vertical blind structure has: an upper track, at least one track set and a plurality of blades. The upper track with an adjustable length has an inner track and an outer track, and the inner track and the outer track are disposed on a same side and connected to each other with a connecting track. The inner and outer tracks of the upper track respectively have an engaging portion and further have a plurality of clamping members. The at least one track set has a plurality of sliding tracks parallel with each other, and each sliding track has a positioning groove and a corresponding limiting groove at two opposite sides and a storing groove at a bottom side. An end of each positioning groove of the sliding track comprises a sliding block.

9 Claims, 17 Drawing Sheets

VERTICAL BLINDS

BACKGROUND OF THE INVENTION

1. Field of the Invention

The present invention relates to blinds, and more particularly to a vertical blinds structure.

2. Description of the Related Art

According to the structure of conventional vertical blinds, as shown in FIG. 17, the vertical blinds 40 include a support base 41, and a plurality of slide tracks 42 (three shown) arranged side by side on the support base 41 are respectively arranged on the rails rod 43 of each slide rails 42. The upper end of the rail 43 is coupled with two pulleys 431 disposed in the slide track 42. The blades 44 are respectively disposed on each rail 43, and a pull cord 45 is disposed on the support base 41 and drives a pulley 431 to move. The rail 43 is provided with a plurality of limiting blocks 432 as a stopper for each pulley 431.

It is not difficult to find out that the above-mentioned conventional structure has some shortcomings. The main reason is as follows: the rail 43 of the conventional blinds structure are slidably disposed in the sliding track 42 of the support base 41 through the pulley 431, therefore the track 42 of the support base 41 must be matched with the size of the pulley 431, which results in an increase in the manufacturing costs and the packaging volume of the support base 41 and also increases the difficulty in assembling, which is necessary for improvement.

Therefore, it is desirable to provide a vertical blinds structure to mitigate and/or obviate the aforementioned problems.

SUMMARY OF THE INVENTION

An objective of embodiments of the present invention is to provide a vertical blinds structure with improvements.

To achieve these and other objects of the present invention, a vertical blind structure comprises: an upper track, at least one track set and a plurality of blades. The upper track with an adjustable length has an inner track and an outer track, and the inner track and the outer track are disposed on a same side and connected to each other with a connecting track. The inner and outer tracks of the upper track respectively have an engaging portion and further have a plurality of clamping members. The clamping member has a clasping portion and an assembly opening at a vertical outer side of the upper track, and the assembly opening has two limiting slots on two opposite sides. The assembly opening is configured for holding two hook-and-loop fastening strips for securing a curtain trim. The at least one track set has a plurality of sliding tracks parallel with each other, and each sliding track has a positioning groove and a corresponding limiting groove at two opposite sides and a storing groove at a bottom side. An end of each positioning groove of the sliding track comprises a sliding block.

Other objects, advantages, and novel features of invention will become more apparent from the following detailed description when taken in conjunction with the accompanying drawings.

DETAILED DESCRIPTION OF THE PREFERRED EMBODIMENT

Figure 1:
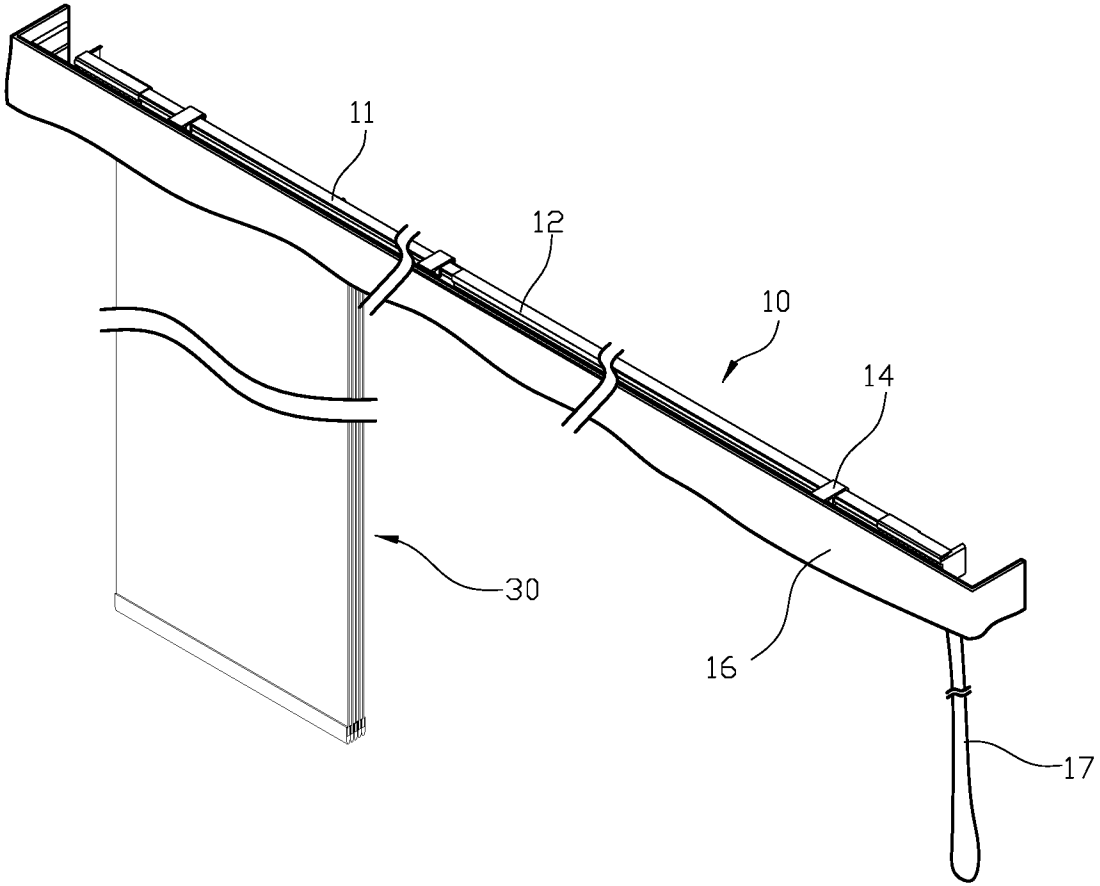
FIG. 1 is a perspective view of a preferred embodiment of the present invention.
Figure 2:
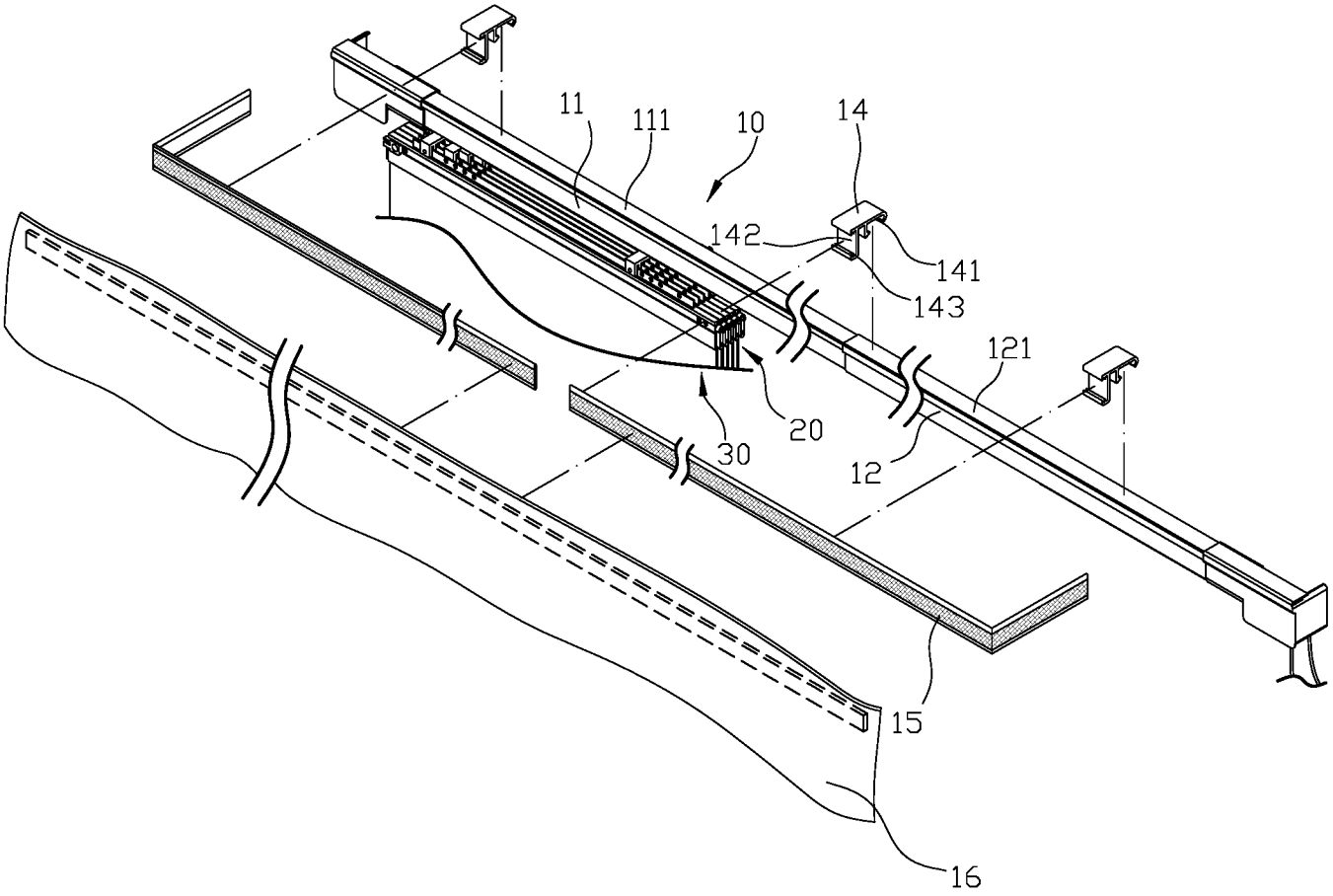
FIG. 2 is an exploded view of the preferred embodiment of the present invention.
Figure 3:
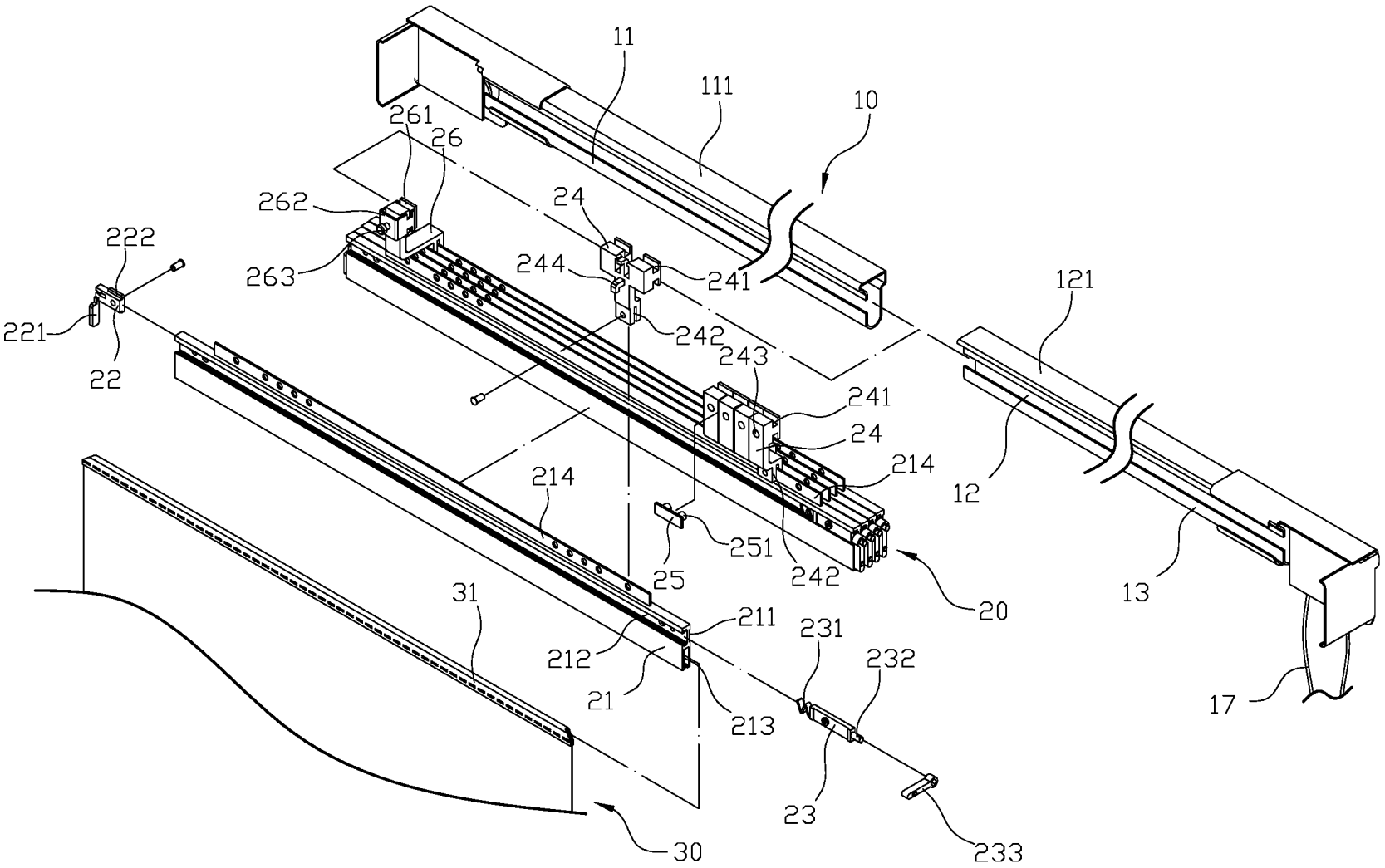
FIG. 3 is an exploded view of another perspective according to the preferred embodiment of the present invention.

First, please refer to FIGS. 1, 2, and 3. A vertical blind structure comprises: an upper track 10, at least one track set 20 and a plurality of blades 30. The upper track 10 with an adjustable length has an inner track 11 and an outer track 12, and the inner track 11 and the outer track 12 are disposed on a same side and connected to each other with a connecting track 13. The inner and outer tracks 11, 12 of the upper track 10 respectively have an engaging portion 111, 121 and further have a plurality of clamping members 14. The clamping member 14 has a clasping portion 141 and an assembly opening 142 at a vertical outer side of the upper track 10, and the assembly opening 142 has two limiting slots 143 on two opposite sides. The assembly opening 142 is configured for holding two hook-and-loop fastening strips 15 for securing a curtain trim 16. The at least one track set 20 has a plurality of sliding tracks 21 parallel with each other, and each sliding track 21 has a positioning groove 211 and a corresponding limiting groove 212 which are on two opposite sides of the sliding track 21, and a storing groove 213 at a bottom side of the sliding track 21.

An end of each positioning groove 211 of the sliding track 21 comprises a sliding block 22, and the sliding block 22 further has a blocking plate 221 blocking one end of the storing groove 213. The sliding block 22 is slidably disposed in the limiting groove 212 of another adjacent sliding track 21 and further has two symmetric limiting fins 222 facing the limiting groove 212 of the adjacent sliding track 21.

A limiting block 23 having an elastic buffering piece 231 is disposed at a front end of each limiting groove 212 of each sliding track 21. A rotatable block 233 is pivoted onto a protrusion 232 protruding from the limiting groove 212 of each limiting block 23.

A connecting rib 214 is disposed on each sliding track 21, and the connecting rib 214 is provided with a plurality of apertures and a connecting block 24 at its front end. Each connecting block 24 has a first slidable fastening portion 241 and a connecting portion 242 with a corresponding length. Each connecting block 24 utilizes the connecting portion 242 to secure onto the corresponding connecting rib 214 of the sliding track 21, such that all first slidable fastening portions 241 align and are close to each other. Each connecting block 24 has a through aperture 243 facing the opening of the connecting track 13 and is coupled with a linking piece 25 the connects at least two connecting blocks 24 on the at least two sliding tracks 21.

The very first connecting block 24 on the connecting track 13 further has a rope securing portion 244. The very last sliding track 21 further has a positioning block 26 on the connecting rib 214. The positioning block 26 further has a second slidable fastening portion 261 engaging with the connecting track 13 of the upper track 10, and an opening of the second slidable fastening portion 261 facing the upper track 10 comprises a packing piece 262 coupled with a locking screw 263. Therefore, the positioning block 26 and the upper track 10 are engaged together. The plurality of blades 30 each has a strip 31 which slides in the storing groove 213 of the sliding track 21 and is limited between the blocking plate 221 and the rotatable block 233 at two ends.

Figure 4B:
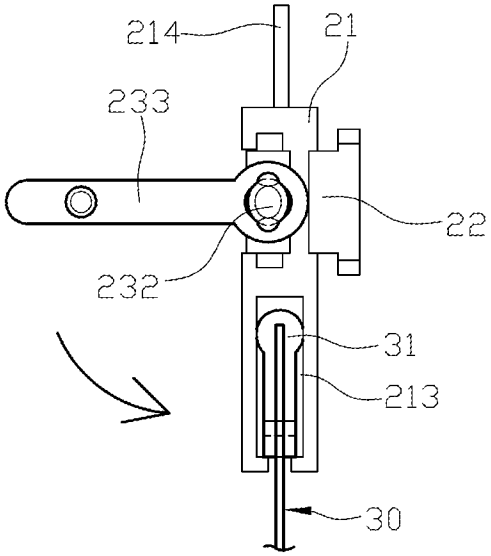
FIGS. 4A and 4B are schematic diagrams showing installation of the blades according to the preferred embodiment of the present invention.
Figure 4A:
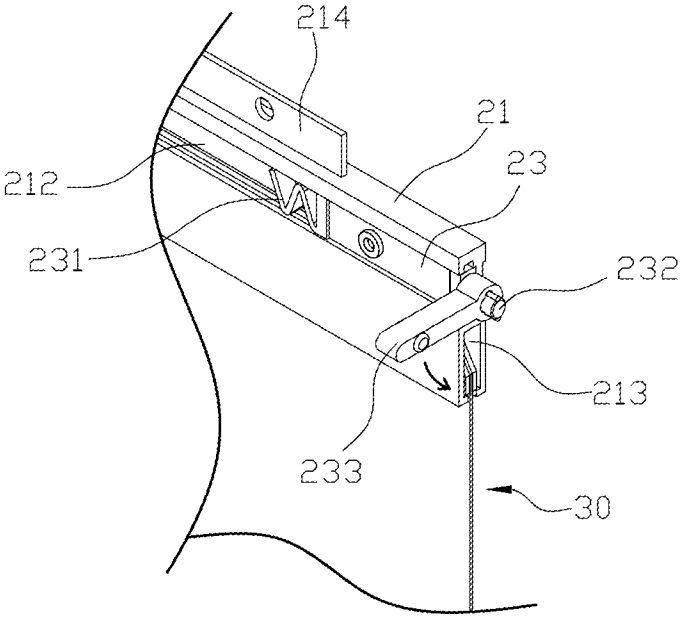
Figure 5B:
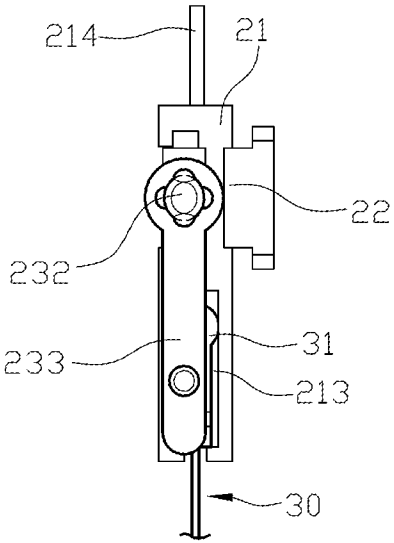
FIGS. 5A and 5B are schematic diagrams showing the blade being restricted by the rotatable block according to the preferred embodiment of the present invention.
Figure 5A:
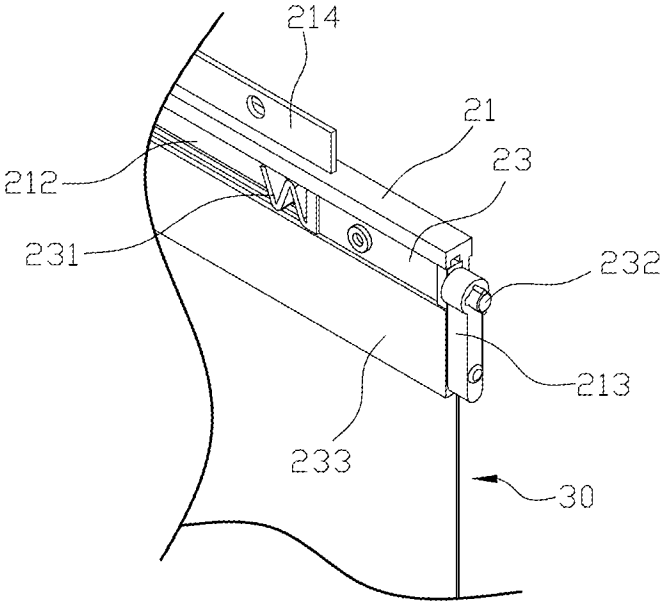
Figure 6:
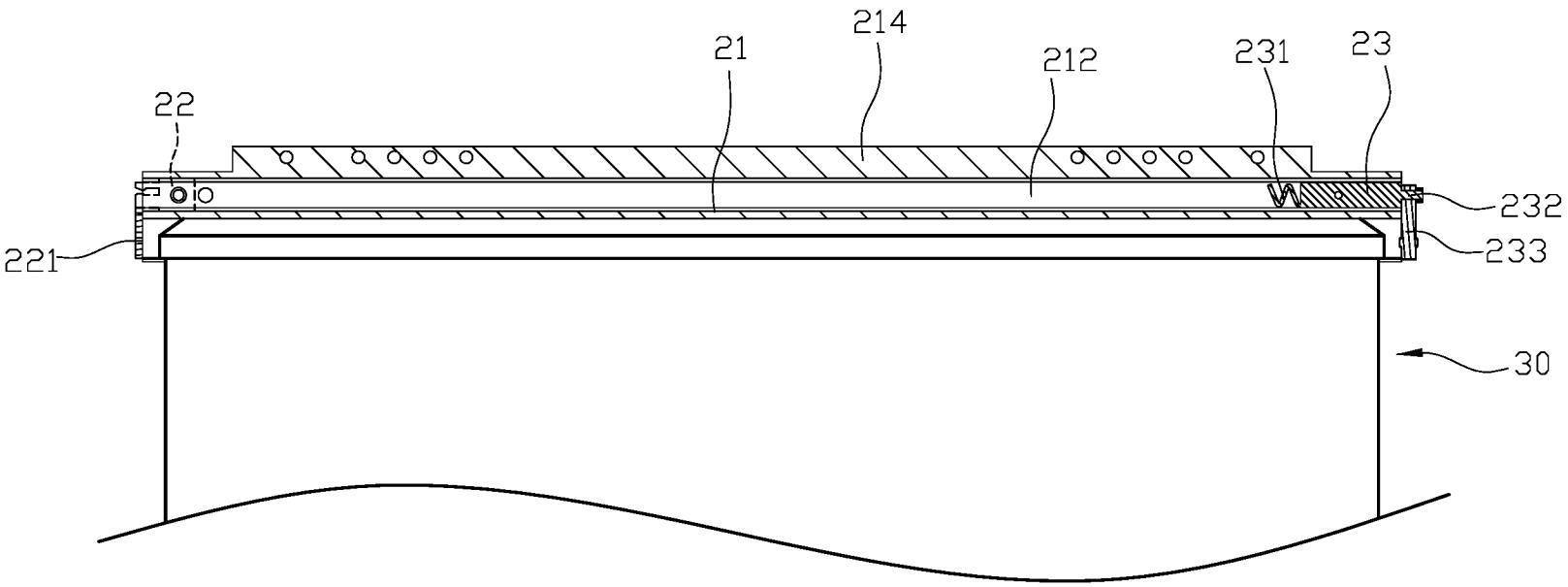
FIG. 6 is a schematic diagram of a single sliding track and its blades according to the preferred embodiment of the present invention.

Please refer to FIGS. 2 and 3 with FIGS. 4, 5 and 6. Each sliding track 21 of the track set 20 is fixed with a sliding block 22 at the end of the positioning groove 211, and a limiting block 23 is disposed at the front end of the limiting groove 212. Each sliding track 21 is disposed side by side, and the sliding block 22 slides from the end of one limiting groove 212 to another positioning groove 211 of the adjacent sliding track 21. The plurality of the sliding tracks 21 are thus sequentially connected. When the sliding track 21 at the first position is pulled out and the sliding block 22 moves along the limiting groove 212 of the other sliding track 21, the limiting block 23 at the front end of the limiting groove 212 pulls out another sliding track 21, thereby achieving pulling the interlocking sliding tracks 21 one by one.

Each storage groove 213 at the bottom of each sliding track 21 is respectively provided with a blade 30. One end of the blade 30 is restricted by the blocking plate 221 of the sliding block 22, and the other end of the blade 30 is blocked by the rotation of the rotatable block 233, thereby completing the installation of the blades 30.

Each sliding track 21 of the track set 20 is installed separately with a connecting block 24, and the connecting block 24 utilizes the connecting portion 242 for attachment to the front end of the connecting rib 214 of the corresponding sliding track 21. The first slidable fastening portion 241 of the connecting block 24 can be disposed in parallel on the same straight line. The connecting block 24 of the very first sliding track 21 is further provided with the rope securing portion 244, and the sliding track 21 of the last in order is further provided with a positioning block 26. The positioning block 26 is also provided with the second slidable fastening portion 261 aligning with the first slidable fastening portions 241 of the connecting blocks 24, whereby the sliding tracks 21 are mounted in the connecting track 13 of the upper track 10 via the first and second slidable fastening portions 241, 261 of the connecting blocks 24 and the positioning blocks 26. The positioning block 26 is further provided with a packing piece 262 and positioned with the inner wall of the rail 13 through a locking member 263, so that the sliding track 21 at the last position is not pulled out and thus providing a fixed state. The upper track 10 is further coupled with a rope 17 to achieve the sliding displacement of the track set 20, and the rope 17 is tied to the connecting block 24 of the track set 20 the first in order so as to complete the curtain structure.

Figure 7:
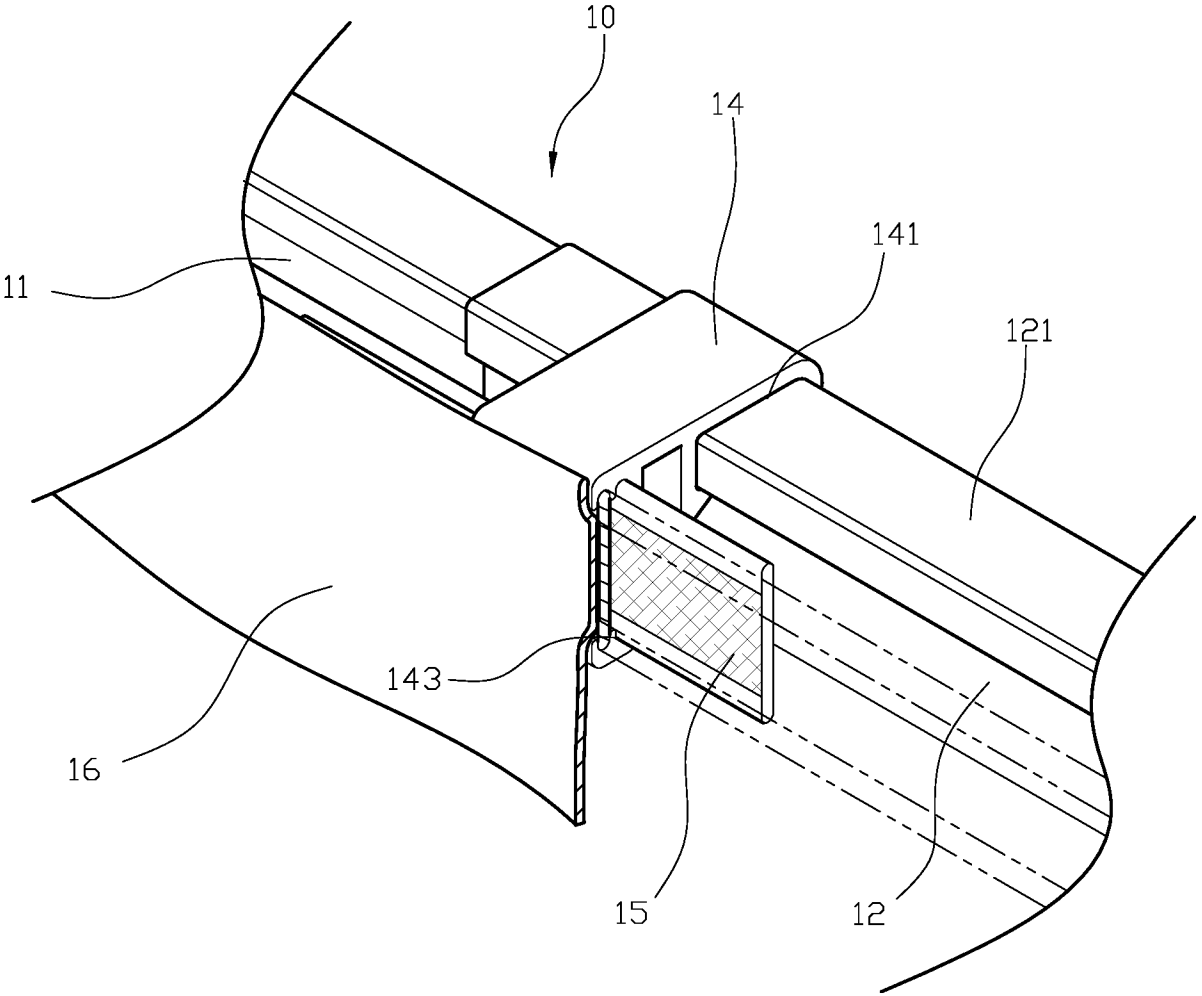
FIG. 7 is a schematic diagram of the installation of the curtain trim according to the preferred embodiment of the present invention.
Figures 8A, 8B, 8C:
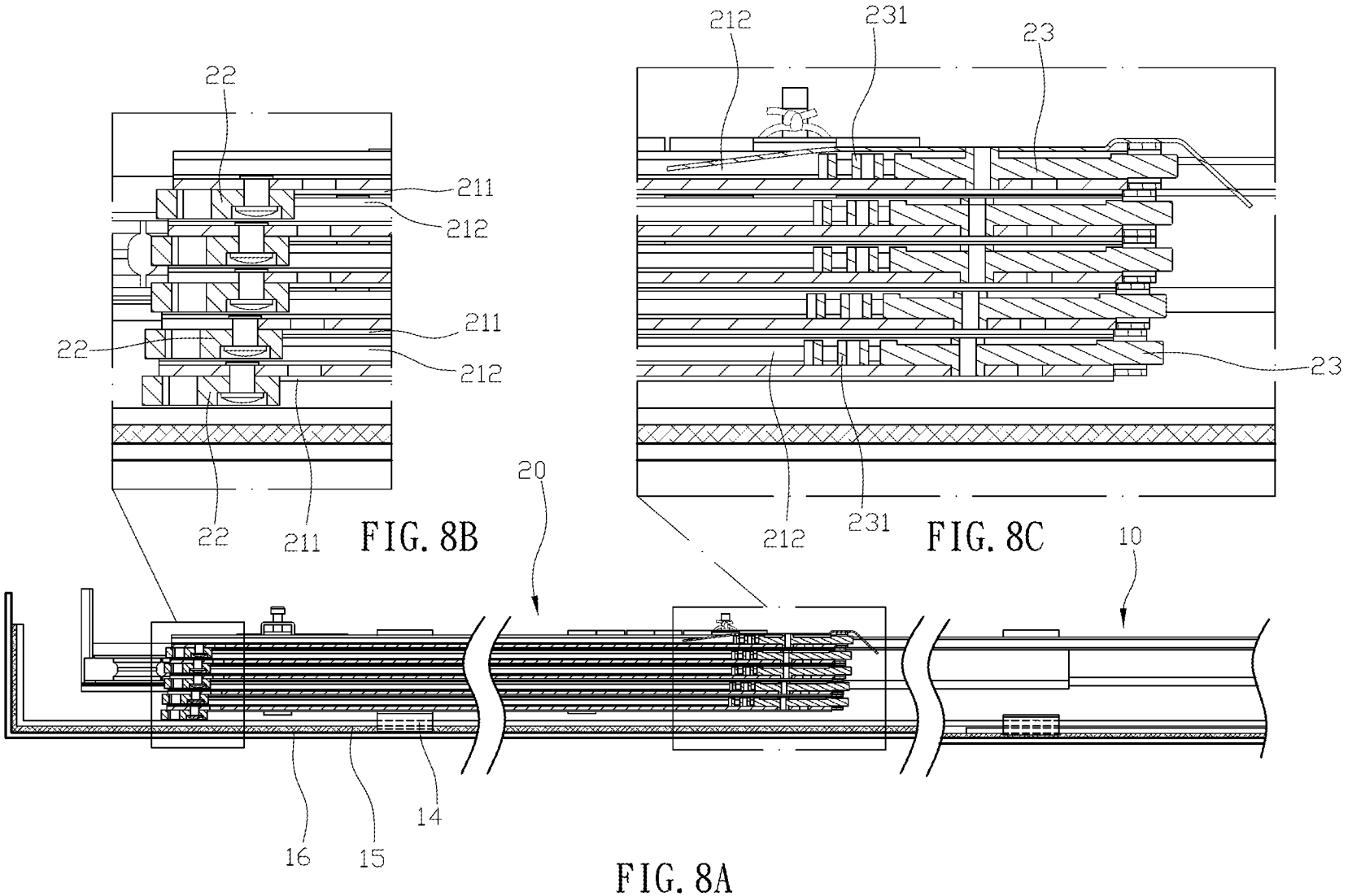
FIG. 8A is a cross-sectional view of the collapsed state according to the preferred embodiment of the present invention.
FIGS. 8B and 8C are detailed views of respective portions of FIG. 8A.
Figure 9:
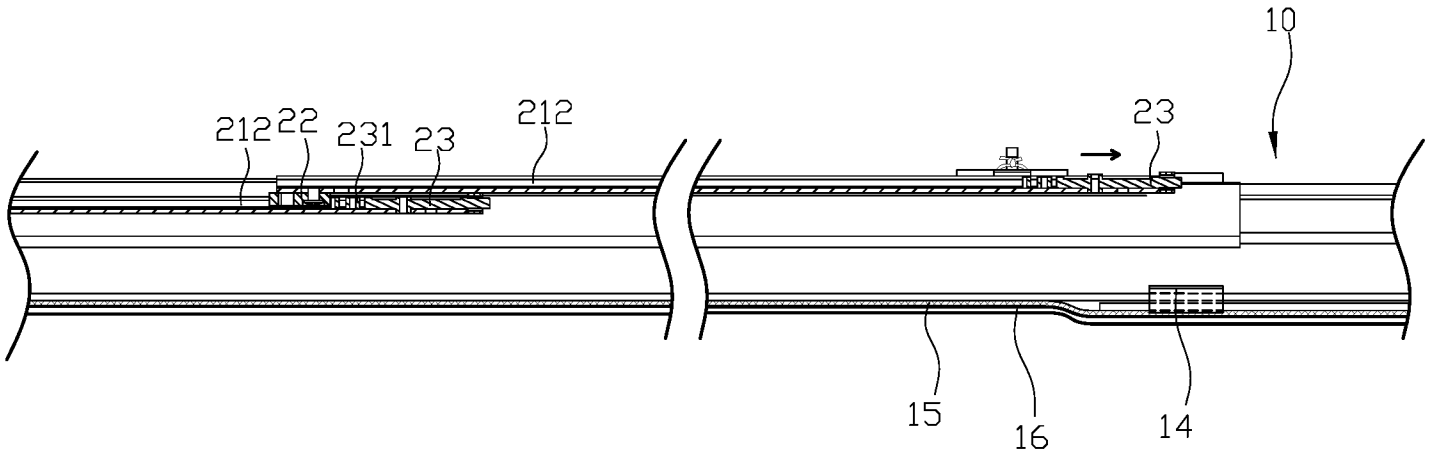
FIG. 9 is a schematic diagram of the linkage state according to the preferred embodiment of the present invention.
Figure 10:
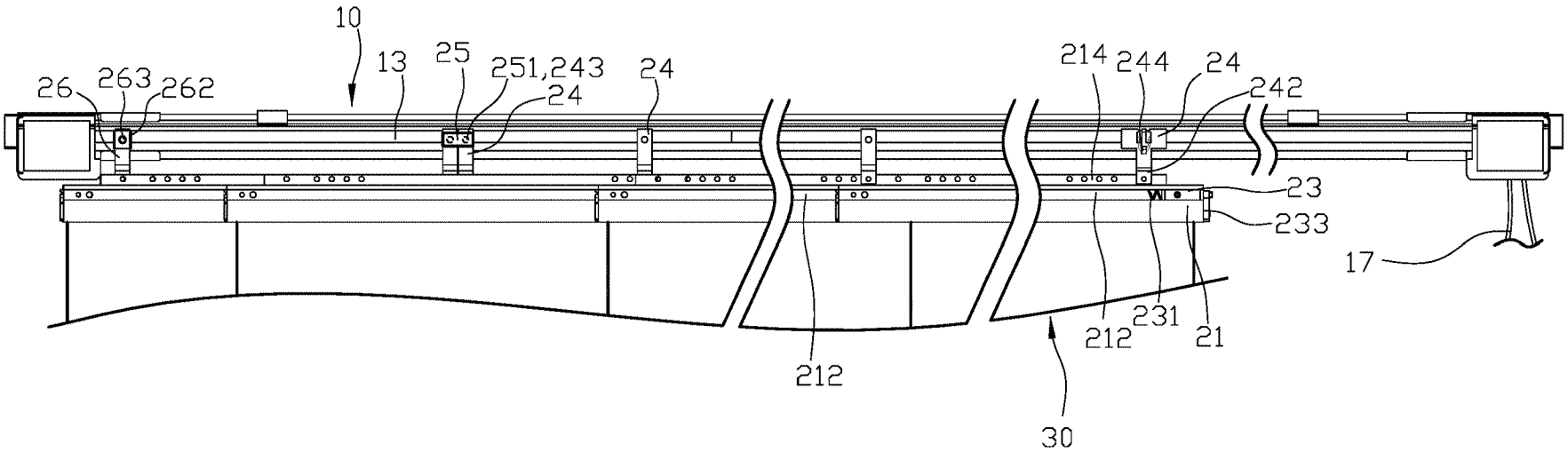
FIG. 10 is a schematic diagram of the sliding block by the linking piece according to the preferred embodiment of the present invention.

In addition, as shown in FIG. 7, the upper track 10 is further provided with a plurality of clamping members 14, which are fixed onto the engaging portions 111, 121 of the inner and outer tracks 11, 12 by the clasping portions 141. The two fastening strips 15 are fixed by the limiting groove 143 of the assembly openings 142, so that the two fastening strips 15 are staggered and fixed on the same clamping member 14 and can be stretched and retracted along the upper track 10 for adjustable lengths. Finally, the curtain fabric 16 is provided for shielding and decorative effect to the upper track 10.

For actual use of the structure, please refer to FIGS. 1 with 8, 9, 10, and 11. The as the upper track 10 of the vertical blades structure is installed on a wall for windows or floor-to-ceiling windows. When the blades 30 are not spread out in a collapsed state, the blades 30 are pushed to the side of the upper track 10 when the sliding tracks 21 of the track set 20 are pulled by the rope 17. The sliding tracks 21 are parallel and the blades 30 overlap each other into a stack. In order to use the blades 30 for shading purposes, the rope 17 is pulled to move the sliding track 21 of the track set 20 at the first position along the track 13, and the sliding block 22 at the end of the positioning groove 211 moves along the limiting groove 212 of the other adjacent sliding track 21 to touch the adjacent limiting block 23. The limiting block 23 is further provided with the buffering elastic piece 231 for reducing the abutting force of the sliding track 21. By pulling the first other sliding track 21 out, other sliding tracks are one by one caused to slide along the track 13, and the last sliding track 21 is fixed to the upper track 10 by the positioning block 26 so that the track set 20 is accompanied by the blades 30 and forms a fully expanded state on the upper track 10 to achieve an indoor shading effect.

Figure 11:
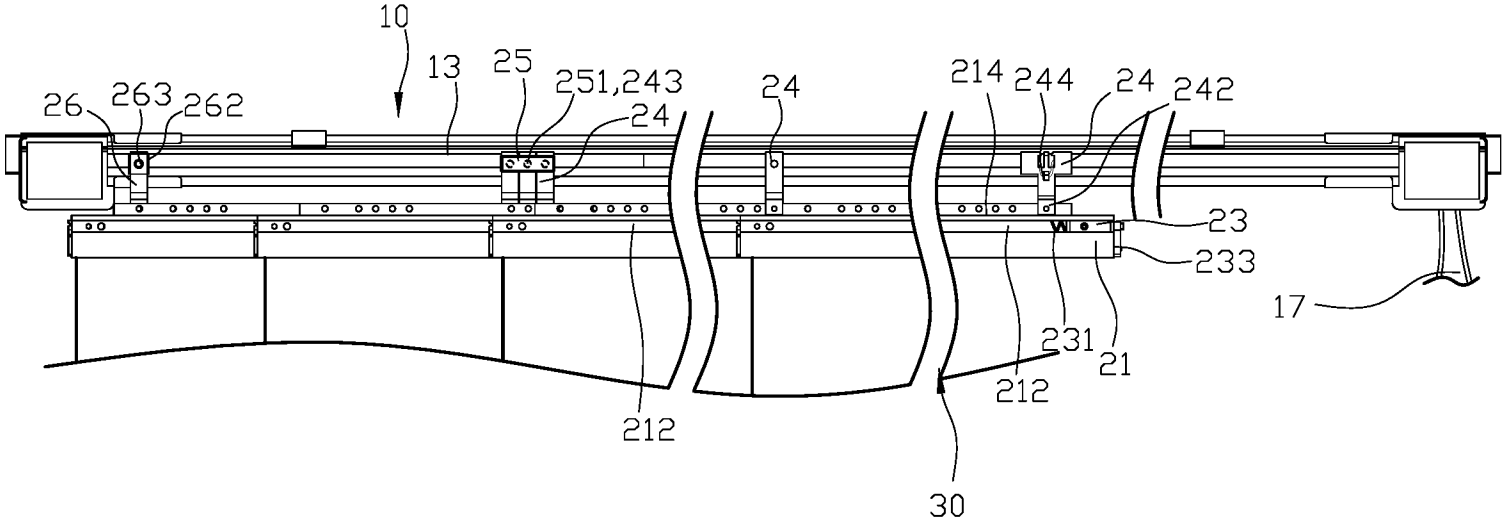
FIG. 11 is a schematic diagram of the three sliding tracks being secured by the linking piece according to the preferred embodiment of the present invention.
Figure 12:
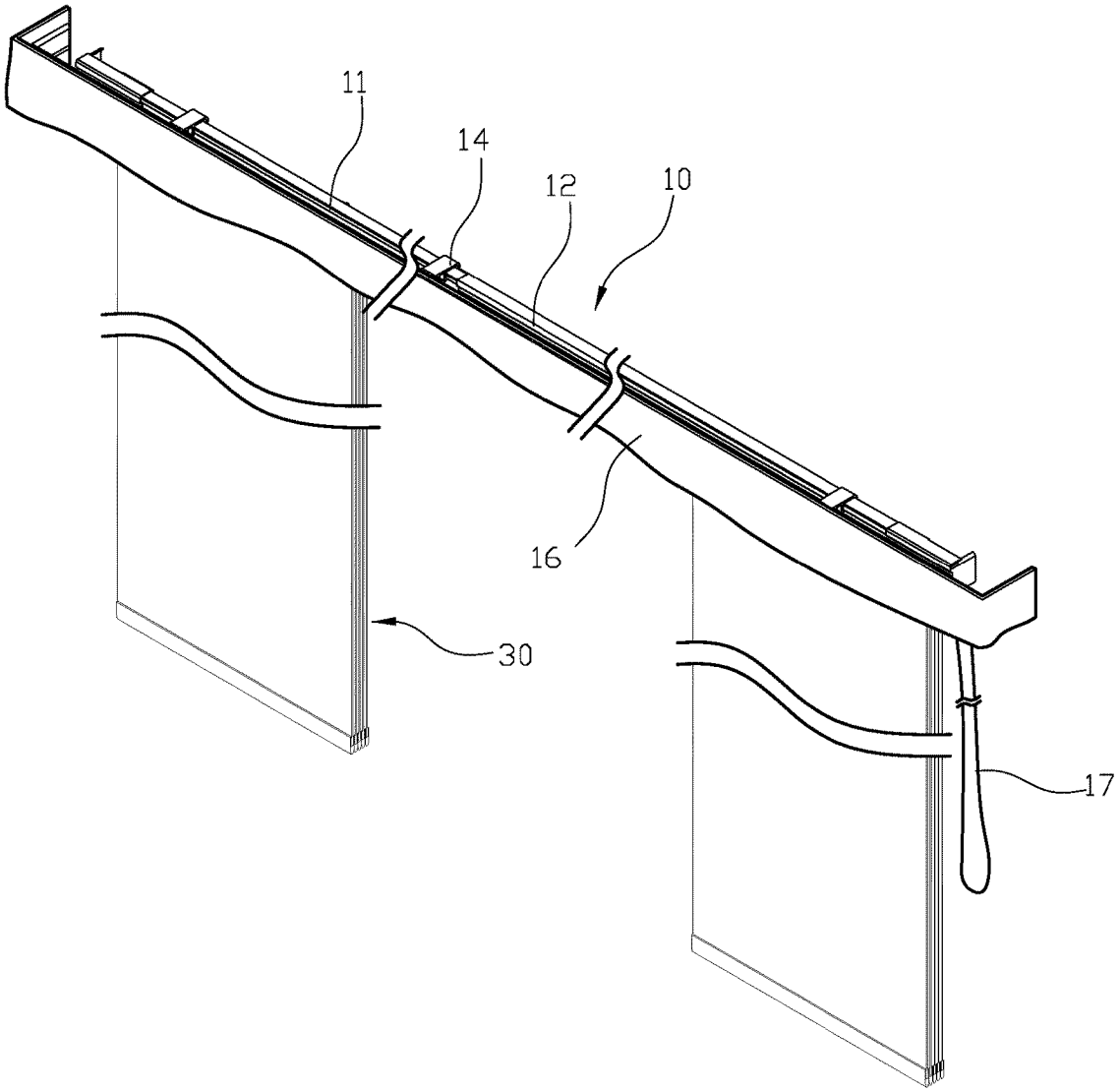
FIG. 12 is a perspective view of another embodiment of the present invention.
Figure 13:
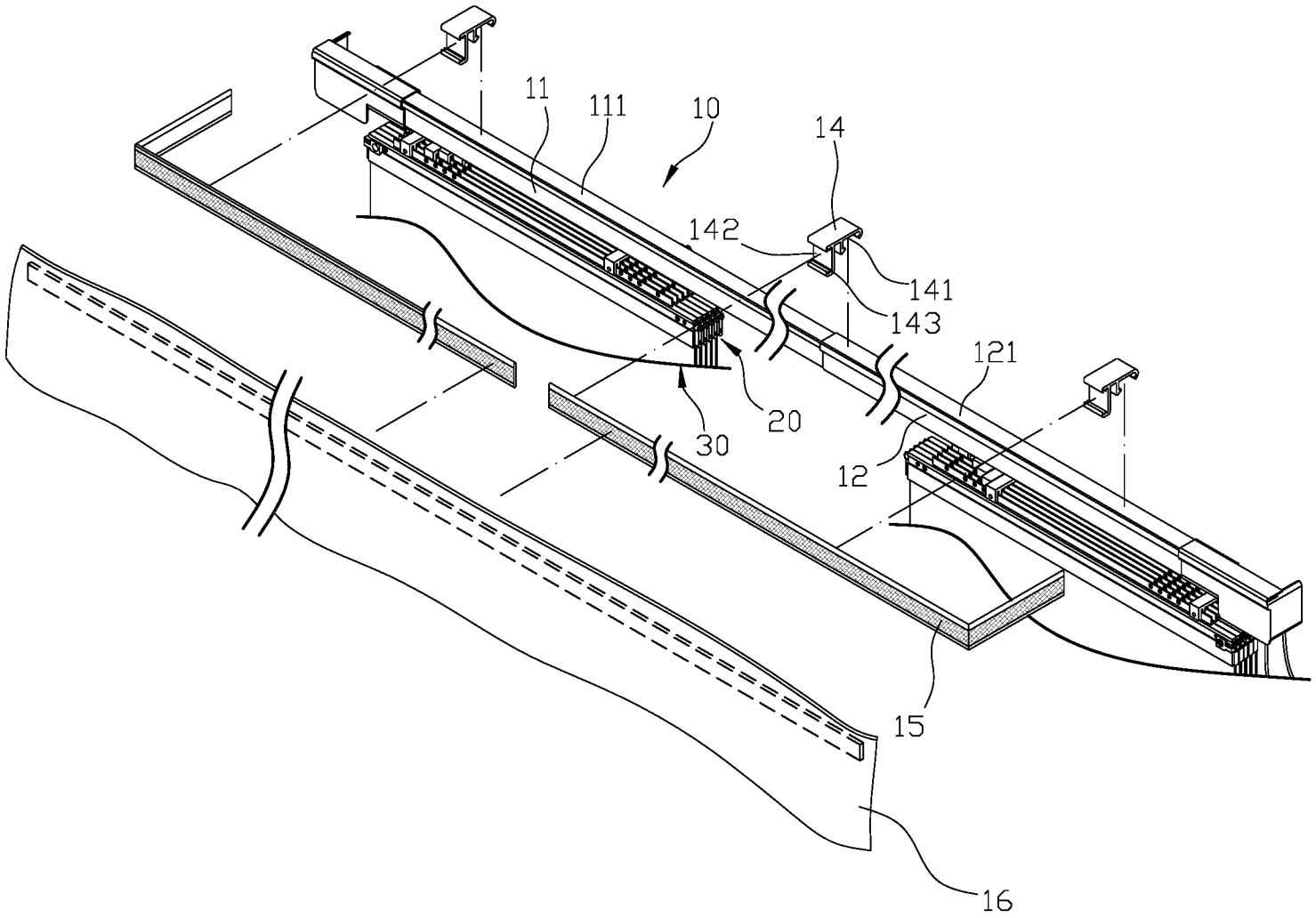
FIG. 13 is an exploded view of another embodiment of the present creation.
Figure 14:
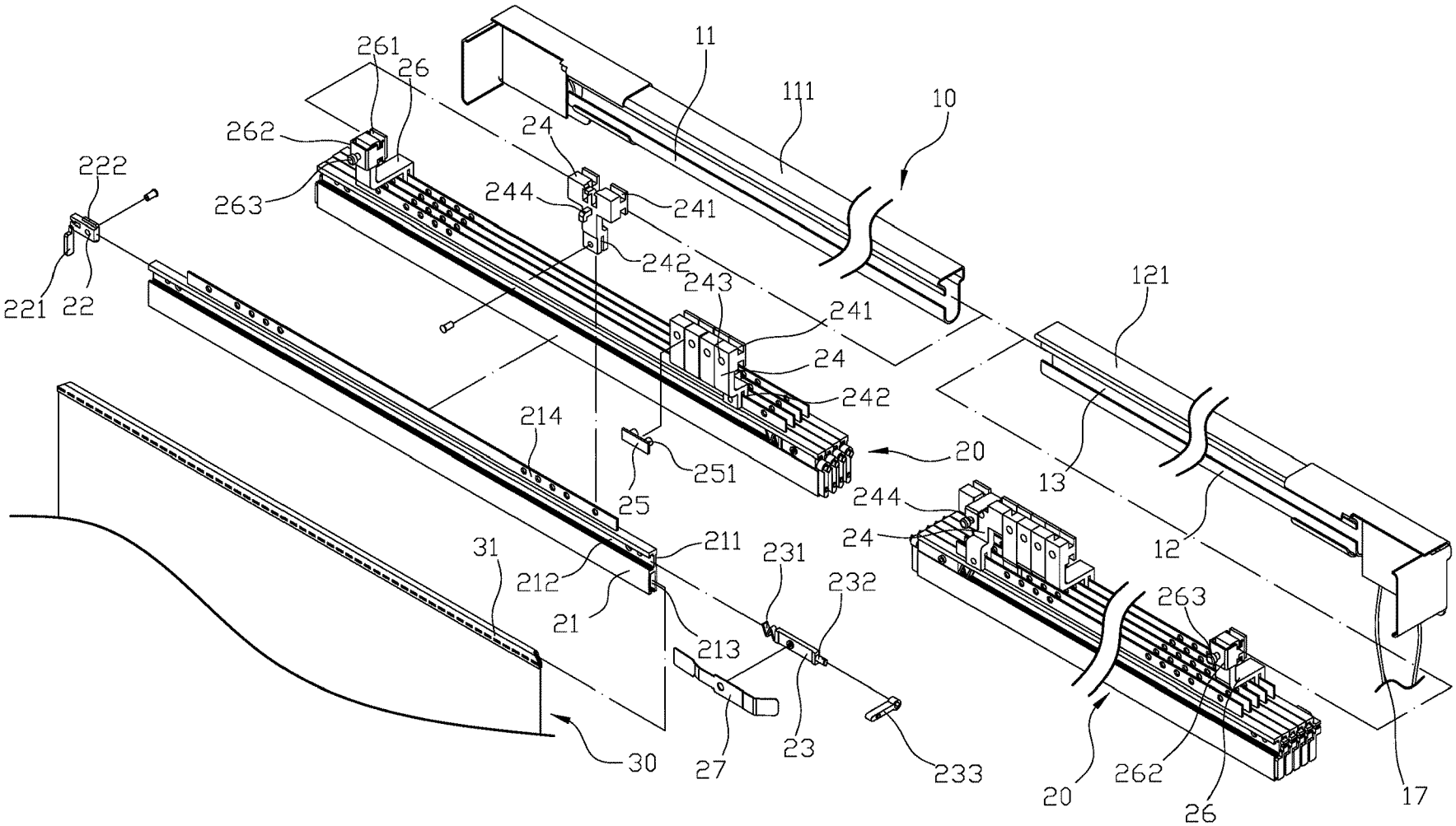
FIG. 14 is another perspective exploded view of another embodiment of the present invention.
Figure 15:
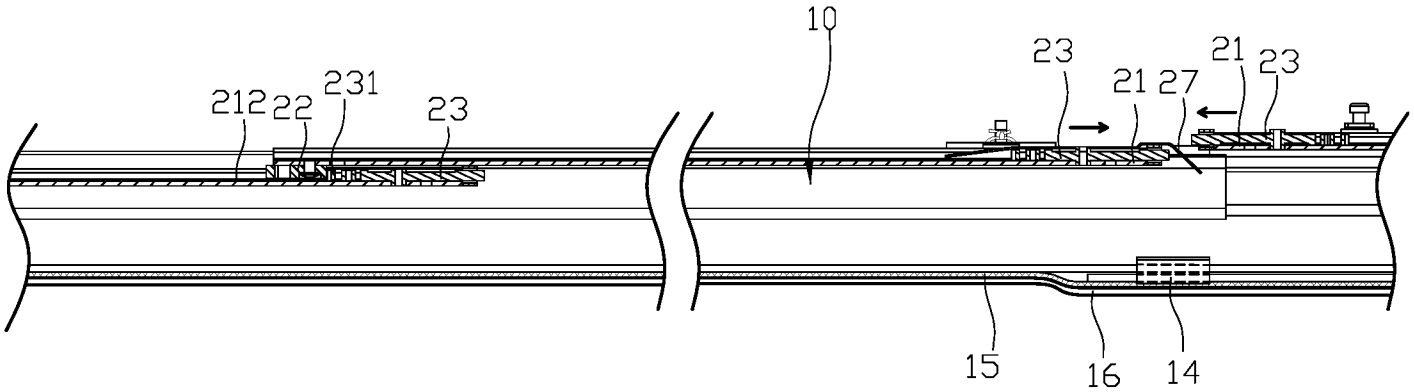
FIG. 15 is a schematic diagram showing the unfolded state of another embodiment of the present creation.
Figure 16:
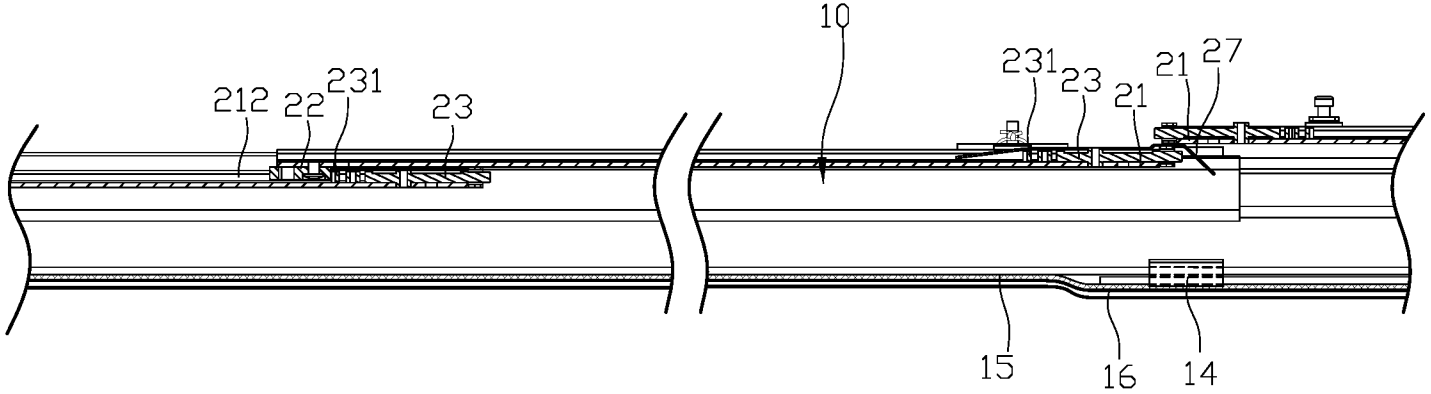
FIG. 16 is a schematic view showing the unfolding and overlapping state of another embodiment of the present creation.
Figure 17:
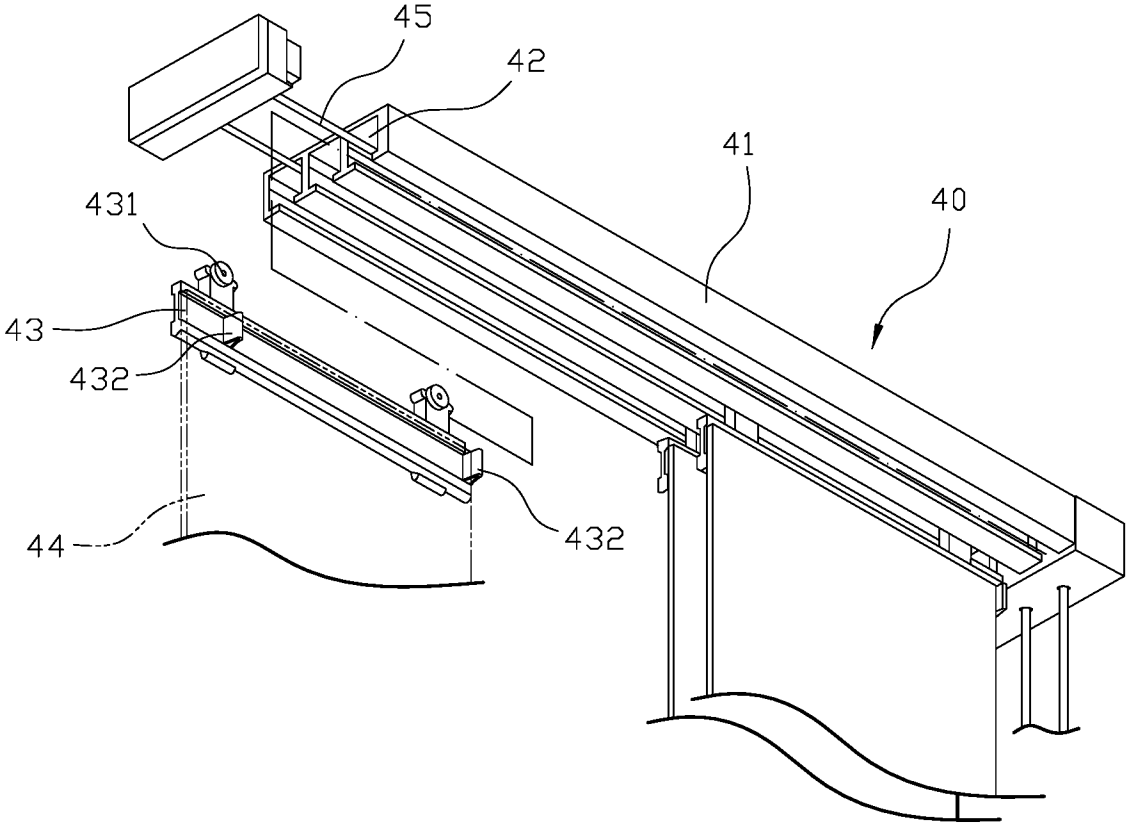
FIG. 17 PRIOR ART
FIG. 17 is a schematic diagram of the prior art.

In addition, since the upper track 10 is a combination of the inner track 11 and the outer track 12, the its length can be adjusted by telescopic adjustment, and the number of sliding tracks 21 of the track set 20 can be adjusted with the length of the upper track 10 accordingly. Furthermore, when the combined length of the inner track 11 and the outer track 12 is shortened, the track set 20 can also be augmented with the linking pieces 25 to shorten the length of each sliding track 21 and its blades 30. Each linking piece 25 is provided with at least two columns 251 corresponding to the connecting blocks 24, and the two columns 251 are inserted into the through holes 243 of two adjacent connecting blocks 24. Therefore, the two adjacent connecting blocks 24 are synchronously pulled out, and the two sliding tracks 21 and the attached blades 30 are simultaneously pulled out, achieving the shortening of the upper track 10 or not fully expanded effect. Moreover, the linking piece 25 may have three columns 251, as show in FIG. 11, which allows three sliding tracks 21 of the track set 20 and attached blades 30 to be simultaneously pulled out to reduce the pulled out area of two of the sliding tracks 21 and two of the blades 30.

On the other hand, in order to spread out the blades 30, the sliding track 21 in the first position is retracted along the track 13 of the upper track 10 by pulling the rope 17 in a reverse direction. With the sliding track 21 sliding in the reverse direction, the connecting block 24 abuts against the connecting block 24 of the other adjacent sliding track 21, and then the other sliding track 21 is pushed back and pulls back the others one by one.

In another embodiment of the structure, as shown in FIGS. 12, 13, 14, 15, and 16, the upper track 10 can also accommodate two track sets 20, and the two track sets 20 are mounted on the outer ends of the inner track 11 and the outer track 12 respectively. The two track sets 20 are provided with the rope securing portions 244 located on the connecting block 24 of the sliding track 21 at the first position. The sliding track 21 at the last position is provided with a positioning block 26 fixed by a packing piece 262 with a locking screw 263. Subsequently, the two track sets 20 are able to be closed and separated from each other. The sliding tracks 21 of the two track set 20 are misaligned, so that the sliding tracks 21 of the two track sets 20 in the first position on the opposite side are staggered to form a closed state. Moreover, an offsetting elastic member 27 is disposed at the front end of an inner side of the sliding track 21 and used to ensure the offset state of the two sliding tracks 21.

With the structure of the above specific embodiment, the following benefits can be obtained: (1) Each sliding track 21 of the track set 20 is installed separately with a connecting block 24, and the connecting block 24 utilizes the connecting portion 242 to be attached to the front end of the connecting rib 214 of the sliding track 21 correspondingly. Therefore, the connecting block 24 and the slidable fastening portion 241 of each sliding track 21 can be located on the same line and installed on the connecting track 13 of the upper the track 10, so the size of the upper track 10 can be greatly reduced, and the packaging volume can be effectively reduced too.

(2) Further, an end of each positioning groove 211 of the sliding track 21 comprises a sliding block 22, and the sliding block 22 further has a blocking plate 221 blocking one end of the storing groove 213. A limiting block 23 has an elastic buffering piece 231 disposed at a front end of each limiting groove 212 of the sliding track 21, and the limiting block 23 further has a rotatable block 233. Therefore, the blade 30 can be mounted in the storage groove 213 and limited by the blocking plate 221 and the rotatable block 233, thereby preventing the blade 30 from falling off. When the blade 30 needs to be replaced, the blade 30 can be easily pulled out by rotating the rotatable block 233.

(3) In addition, the upper track 10 is further equipped with the plurality of clamping members 14 for securing the two fastening strips 15, and then the curtain fabric 16 can be attached onto the fastening strips 15 to provide shading and decorative effects.

Although the present invention has been explained in relation to its preferred embodiment, it is to be understood that many other possible modifications and variations can be made without departing from the spirit and scope of invention as hereinafter claimed.

What is claimed is:

1. A vertical blind structure comprising:

an upper track with an adjustable length having an inner track and an outer track, the inner track and the outer track connected to each other, the upper track further having a plurality of clamping members, each clamping member comprising at least two hook-and-loop fastening strips configured for securing a curtain trim;

a first track set having a plurality of sliding tracks in parallel with each other, each sliding track having a positioning groove and a corresponding limiting groove, the positioning groove and the corresponding limiting groove of each sliding track being on opposite sides of the sliding track, each sliding track further comprising a storing groove at a bottom side thereof;

an end of the positioning groove of each sliding track comprising a sliding block, each sliding block of the respective sliding track comprising a blocking plate blocking one end of the storing groove of the respective sliding track;

the sliding block of at least one of the sliding tracks slidably disposed in the limiting groove of a respective adjacent sliding track;

a respective limiting block having an elastic buffering piece disposed at a front end of the limiting groove of each sliding track, a rotatable block pivoted onto each limiting block and configured to selectively block another end of the storing groove of the respective sliding track;

a respective connecting rib disposed on each sliding track, each connecting rib connected to a respective connecting block, each connecting block having a first slidable fastening portion, and a connecting portion with a corresponding length connected to the respective connecting rib, wherein the first slidable fastening portions of the connecting blocks align with each other;

the connecting block of a first sliding track of the plurality of sliding tracks further having a rope securing portion, a second sliding track of the plurality of sliding tracks further having a positioning block on the connecting rib of the second sliding track engaging with the upper track; and a plurality of blades each having a strip disposed in the storing groove of a respective sliding track and limited between the blocking plate and the rotatable block at the two ends of the storing groove.

2. The vertical blind structure as claimed in claim 1, wherein the inner and outer tracks of the upper track respectively have an engaging portion, and each clamping member has a clasping portion and an assembly opening, the at least two hook-and-loop fastening strips coupled to the assembly opening, and the assembly opening further has two limiting slots on two opposite sides.

3. The vertical blind structure as claimed in claim 1, wherein the positioning block further has a second slidable fastening portion engaging with the upper track, and an opening of the second slidable fastening portion facing the upper track comprises a packing piece coupled with a locking screw.

4. The vertical blind structure as claimed in claim 1, wherein each connecting block has a through aperture configured to couple with a linking piece, the linking piece configured to connect together at least two connecting blocks.

5. The vertical blind structure as claimed in claim 4, wherein the linking piece further has at least two columns corresponding to the at least two connecting blocks.

6. The vertical blind structure as claimed in claim 1, wherein each sliding block further has two symmetric limiting fins facing the limiting groove of an adjacent sliding track.

7. The vertical blind structure as claimed in claim 1, further comprising a second track set, the first track set and the second track set respectively disposed at an outer end of the inner track and the outer track and are capable of overlapping together and opening away from each other.

8. The vertical blind structure as claimed in claim 7, wherein the track sets are offset from each other.

9. The vertical blind structure as claimed in claim 1, wherein the upper track further has a pulling rope for moving the first track set.

* * * * *